US008538308B2

(12) United States Patent
Kashiwakura et al.

(10) Patent No.: US 8,538,308 B2
(45) Date of Patent: Sep. 17, 2013

(54) IMAGE FORMING DEVICE

(75) Inventors: Kuniaki Kashiwakura, Toyohashi (JP); Yoshiki Nakane, Toyokawa (JP); Ikuko Kanazawa, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 310 days.

(21) Appl. No.: 12/871,186

(22) Filed: Aug. 30, 2010

(65) Prior Publication Data

US 2011/0052287 A1 Mar. 3, 2011

(30) Foreign Application Priority Data

Sep. 2, 2009 (JP) ..... 2009-202384

(51) Int. Cl.
*G03G 21/00* (2006.01)

(52) U.S. Cl.
USPC ..... 399/346; 399/186; 399/343; 399/353; 399/354

(58) Field of Classification Search
USPC ..... 399/186, 346, 353, 354
See application file for complete search history.

(56) References Cited

U.S. PATENT DOCUMENTS

| | | | | |
|---|---|---|---|---|
| 7,593,682 | B2 * | 9/2009 | Tokumasu et al. | 399/346 |
| 7,693,475 | B2 | 4/2010 | Shakuto et al. | |
| 2007/0122217 | A1 * | 5/2007 | Nagashima et al. | 399/346 |
| 2007/0154246 | A1 | 7/2007 | Shintani et al. | |
| 2007/0166087 | A1 * | 7/2007 | Yamaguchi et al. | 399/346 |
| 2007/0183824 | A1 | 8/2007 | Suda et al. | |
| 2008/0069614 | A1 | 3/2008 | Shintani et al. | |
| 2009/0003858 | A1 * | 1/2009 | Nishida | 399/48 |
| 2009/0290919 | A1 * | 11/2009 | Tanaka et al. | 399/346 |
| 2009/0297238 | A1 * | 12/2009 | Matsuura et al. | 399/346 |

(Continued)

FOREIGN PATENT DOCUMENTS

| | | |
|---|---|---|
| CN | 1979357 A | 6/2007 |
| JP | 2004-021109 | 1/2004 |

(Continued)

OTHER PUBLICATIONS

Office Action (Notification of Reason(s) for Refusal) dated Jul. 19, 2011, issued in the corresponding Japanese Patent Application No. 2009-202384, and an English Translation thereof.

(Continued)

*Primary Examiner* — David Gray
*Assistant Examiner* — Francis Gray
(74) *Attorney, Agent, or Firm* — Buchanan Ingersoll & Rooney PC

(57) ABSTRACT

An image forming device includes a rotation member being held rotatably while making contact with an image carrier, a solid lubricant pressed so as to make contact with the rotation member, and a potential application unit for applying a potential to the rotation member, wherein the material of the solid lubricant and the material of the rotation member are selected so that the charged polarity of the solid lubricant charged due to the friction between the rotation member and the solid lubricant becomes identical with the charged polarity of toner, and the potential to be applied to the rotation member is set so as to be higher or lower than the surface potential of the neutralized image carrier so that the charges having the same polarity as the charged polarity of the solid lubricant are attracted from the rotation member to the neutralized image carrier.

13 Claims, 6 Drawing Sheets

(56) References Cited

U.S. PATENT DOCUMENTS

| | | | | |
|---|---|---|---|---|
| 2010/0054829 | A1* | 3/2010 | Iio et al. | 399/346 |
| 2010/0074634 | A1* | 3/2010 | Ohno et al. | 399/12 |
| 2010/0202812 | A1* | 8/2010 | Watanabe | 399/346 |
| 2010/0248131 | A1* | 9/2010 | Maeda et al. | 430/125.4 |

FOREIGN PATENT DOCUMENTS

| | | | | |
|---|---|---|---|---|
| JP | 2004-334092 | | | 11/2004 |
| JP | 2005-331856 | | | 12/2005 |
| JP | 2006-251751 | A | | 9/2006 |
| JP | 2007-310336 | A | | 11/2007 |
| JP | 2008-076426 | | | 4/2008 |
| JP | 2008-089771 | | | 4/2008 |
| JP | 2008089771 | A | * | 4/2008 |
| JP | 2008-276083 | | | 11/2008 |
| JP | 2008275724 | A | * | 11/2008 |
| JP | 2010032662 | A | * | 2/2010 |

OTHER PUBLICATIONS

Office Action (Notification of Reason(s) for Refusal) dated Dec. 27, 2011, issued in the corresponding Japanese Patent Application No. 2009-202384, and an English Translation thereof. (5 pages).

Chinese Office Action dated Jan. 14, 2013 issued in the corresponding Chinese Patent Application No. 201010271568.9 and English language translation.

Notice of Allowance issued in corresponding Japanese Patent Application No. 2009-202384, mailed on Jun. 19, 2012, and English translation thereof.

* cited by examiner

IN THE CASE OF REVERSE ROTATION

IMAGE FORMING DEVICE

CROSS-REFERENCES TO RELATED APPLICATIONS

This application is based on Japanese Patent Application No. 2009-202384 on Sep. 2, 2009, the contents of which are hereby incorporated by reference.

BACKGROUND OF THE INVENTION

1. Field of the Invention

The present invention relates to an image forming device employing an electrophotographic system, more particularly, to an image forming device capable of supplying a lubricant to an image carrier.

2. Description of the Related Art

In recent years, electrophotographic image forming devices have been demanded to improve image quality with respect to high resolution and photographic image reproduction, for example. As a powerful means for meeting the demand, a method for making toner particles smaller in diameter or spherical has been used.

However, when toner particles are made smaller in diameter or spherical, the toner is liable to pass through the gap between a cleaning blade and a photoconductor. Making the toner particles smaller in diameter increases an adhesion force associated with the Van der Waals force acting between the toner and the photoconductor (image carrier). Furthermore, when the toner particles are made smaller in diameter, the toner is liable to enter the portion (nip portion) between the photoconductor and the cleaning blade. Moreover, when the toner particles are made spherical, the toner is liable to roll at the portion between the photoconductor and the cleaning blade. Therefore, the toner is liable to enter the nip portion by rolling.

If the toner passes through the cleaning blade, the toner remains on the photoconductor. If the remaining toner is transferred together with the next image, image noise, such as black lines, is generated. If the remaining toner blocks the light used for exposure, a portion in which no latent image is formed is generated on the photoconductor.

Therefore, for the purpose of facilitating the cleaning of the toner, technologies have been proposed in which a substance for lowering the friction coefficient of the photoconductor is supplied onto the photoconductor. In these technologies, for example, a lubricant made of a metal salt of a fatty acid, such as zinc stearate, is supplied to the surface of the photoconductor. When the lubricant is supplied onto the photoconductor, the attachment force and the friction force of the toner to the photoconductor are lowered. As a result, the toner can be sufficiently removed even when the cleaning blade or the like is used.

(Lubricant Development Supply System)

A lubricant development supply system is available as a system for supplying a lubricant to the photoconductor. In the lubricant development supply system, a lubricant in a powder form is added to the outside of the toner. When development is performed using the toner, the lubricant is supplied to the photoconductor, and the lubricant in a powder form is formed into a thin film on the photoconductor using a cleaning blade.

Since the lubricant development supply system does not require special components for supplying the lubricant, the system is very advantageous in cost and space. For this reason, the system is adopted for many image forming devices operating in low and middle speed ranges.

However, when the toner to which the lubricant powder is added is stirred inside a developing unit, friction occurs between the toner and the lubricant powder, whereby not only the toner but also the lubricant powder is charged in most cases. In the case that the lubricant powder is charged in the same polarity as the polarity of the toner, the lubricant powder attaches to the image area of the photoconductor. In the case that the lubricant powder is charged in the polarity opposite to that of the toner, the lubricant powder attaches to the non-image area of the photoconductor. Consequently, when the same image is printed continuously or for a long period, portions having different friction coefficients are generated on the surface of the photoconductor. In addition, in the case that a low density image is printed for a long period, the supply amount itself of the lubricant to the cleaning blade decreases. In this case, the friction coefficient on the surface of the photoconductor does not lower sufficiently. Furthermore, when the amount of the lubricant powder to be added to the toner is increased to increase the supply amount of the lubricant, the lubricant powder is liable to be transferred to a toner carrier inside the developing unit. When the lubricant powder is transferred to the carrier, the charge characteristic of the toner is lost, and reversely charged toner is generated. As a result, the toner is developed in the non-image area. In other words, a phenomenon referred to as fogging occurs. Furthermore, when the lubricant is applied to the developing roller of the developing unit, the friction coefficient of the developing roller is lowered. As a result, the toner is not conveyed properly, and the printing image density of a high density image is lowered.

(Lubricant Application System)

As another system for supplying a lubricant to the photoconductor, a lubricant application system is available. In this lubricant application system, a solid lubricant is pressed to a rotatable brush (rotation member), and lubricant powder scraped off with the brush is applied to the photoconductor.

The lubricant application system requires, in addition to a cleaning blade, a roll-shaped brush for scraping off lubricant powder and supplying the scraped lubricant powder to the photoconductor, a solid lubricant, components for holding these, a spring for pressing these, etc. Therefore, the lubricant application system is high in cost, and a large space is required. However, since the lubricant application system can actively apply the lubricant to the photoconductor, the stability of the application is relatively high, and the environmental dependency of the system is small. Furthermore, in the case that the brush is disposed on the upstream side of the cleaning blade, the cleaning ability of the cleaning blade can be enhanced further by actively removing the toner using the brush.

However, when the rotating brush applies the lubricant to the photoconductor, the toner gradually attaches to the surface of the bristles of the brush. Since the toner having attached thereto has a roller action, the brush is difficult to scrape off the solid lubricant. As a result, a required amount of the lubricant powder cannot be supplied stably onto the photoconductor.

Therefore, in order that the toner having attached to the brush can be removed, a toner removing member referred to as a flicker is disposed so that the bristles of the brush make contact therewith. However, when the flicker makes contact with the brush, stress is applied to the fibers of the brush, whereby the fibers are worn or deflected. As a result, the ability of the brush for scraping off the solid lubricant is lowered. In addition, for the purpose of uniformly applying the lubricant to the photoconductor, it is necessary to raise the density of the fibers of the application brush. However, if the density of the fibers is raised, it becomes difficult to remove the toner remaining inside the application brush. As a result, a problem referred to as a toner rolling phenomenon occurs. In other words, the brush is stiffened with the toner and formed into a roller shape. Furthermore, when the density of the fibers is raised, the stiffness of the brush (the stiffness of the bristles) increases. As a result, the surface layer of the photoconductor is damaged or the abrasion of the photoconductor is accelerated.

Still further, in the case that the lubricant application system is applied to an image forming device operating in a high speed range, the capacity of a process unit increases. In the image forming device operating in the high speed range, the service life of the unit is set so as to be relatively long. Therefore, the size of the solid lubricant is required to be increased so that the lubricant can be supplied for a long period. The solid lubricant is also disposed inside the unit. Consequently, the capacity of the unit is increased by increasing the size of the solid lubricant.

In the lubricant development supply system, the toner makes friction contact with the lubricant powder, and the lubricant powder is charged as described above. Therefore, the lubricant powder attaches unevenly to one of the image area and the non-image area. As a result, the distribution of the lubricant on the surface of the photoconductor becomes uneven. On the other hand, even in the lubricant application system, when the lubricant powder is scraped off with the brush from the solid lubricant, the brush makes friction contact with the lubricant powder. As a result, the lubricant powder is charged. The inventors of the present invention have recognized this fact by carrying out experiments. Therefore, even in the lubricant application system, the distribution of the lubricant on the surface of the photoconductor becomes uneven.

Furthermore, in the lubricant application system, since the brush is stained with the toner, the lubricant cannot be supplied to the surface of the photoconductor for a long period. Technologies for solving the problem in which the brush is stained with the toner have been described in Patent Document 1 and Patent Document 2. Patent Document 1 is Japanese Patent Application Laid-open Publication No. 2006-251751, and Patent Document 2 is Japanese Patent Application Laid-open Publication No. 2007-310336.

In the system proposed in Patent Document 1, a solid lubricant is applied on the downstream side of a cleaning blade, and a rubber blade, that is, a so-called leveling blade, is made contact with a photoconductor on the downstream side of the solid lubricant, thereby making the lubricant into a thin film.

With this system, after toner is removed from the photoconductor, an application brush makes contact with the photoconductor. Therefore, it is assumed that the application brush is not stained with the toner and that the surface of the photoconductor is maintained in a state in which the friction coefficient thereof is stably low by virtue of a relatively small amount of the lubricant.

However, this system has the following problems. If the lubricant is not formed into a film by the leveling blade but remains in a particulate state and passes through the leveling blade, the lubricant powder stains a charging unit disposed on the downstream side of the leveling blade. As a result, an improper image is generated. For the purpose of avoiding the generation of such an improper image, the contact force of the leveling blade is required to be set so as to be equal to or higher than the contact force of the cleaning blade. In this case, the friction force generated by the cleaning blade and the friction force generated by the leveling blade are added to the photoconductor. As a result, the load to a drive motor increases. Furthermore, since the leveling blade is installed additionally, it is necessary to secure a space for accommodating the leveling blade inside a process unit. In the case of a unit equipped with a photoconductor having a relatively small diameter, there is a restriction in the placement of the blade. Therefore, it is necessary to make the other electrophotographic process units, such as a charging unit, compact in size. As a result, the cost of the image forming device according to the system increases.

In the system proposed in Patent Document 2, an application brush is disposed so as not to make contact with a photoconductor, and a lubricant is charged by applying a potential to a flicker, whereby the lubricant is attached to the photoconductor by virtue of the electric field formed between the brush and the photoconductor.

In the case of this system, since the brush is disposed so as not to make contact with the photoconductor, the brush is prevented from being stained with toner directly. However, since the brush does not make contact with the photoconductor, it is necessary to scrape off a large amount of the lubricant with the brush so that the lubricant is attached securely to the photoconductor. Therefore, an excessive amount of the lubricant is consumed, and it is necessary to increase the size of the lubricant. As a result, the cost of the image forming device according to this system increases.

SUMMARY OF THE INVENTION

A aspect of the present invention provides An image forming device comprising: a rotation member having conductivity and being held rotatably while making contact with an image carrier; a rotation drive unit for rotating the rotation member; a solid lubricant pressed so as to make contact with the rotation member; a cleaning blade making contact with the image carrier so as to scrape off toner; and a potential application unit for applying a potential having the same polarity as the charged polarity of the image carrier to the rotation member, wherein a developing unit, a transfer unit, a neutralization unit, the rotation member and the cleaning blade are arranged in this order along the movement direction of the surface of the image carrier, the material of the solid lubricant and the material of the rotation member are selected so that the charged polarity of the solid lubricant charged due to the friction between the rotation member and the solid lubricant becomes identical with the charged polarity of the toner charged by the developing unit, and the potential to be applied to the rotation member is set so as to be higher or lower than the surface potential of the neutralized image carrier so that the charges having the same polarity as the charged polarity of the solid lubricant are attracted from the rotation member to the neutralized image carrier.

DETAILED DESCRIPTION OF THE INVENTION

Figure 1:
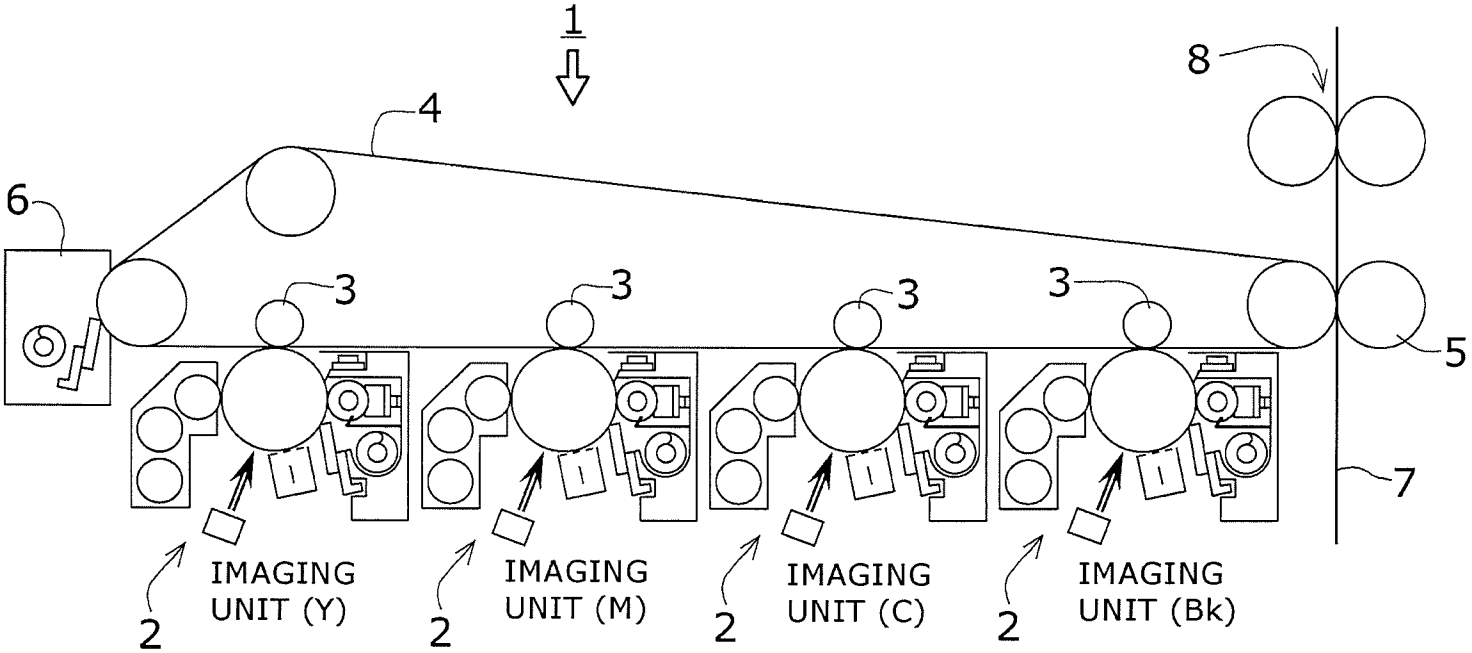
FIG. 1 is a view showing the overall configuration of an image forming device according to an embodiment.

FIG. 1 is a view showing the overall configuration of an image forming device 1 according to an embodiment. The image forming device 1 is equipped with four imaging units 2, four primary transfer rollers 3, an intermediate transfer belt (secondary image carrier) 4, secondary transfer rollers 5, an intermediate transfer cleaner 6 and a fixing unit 8. The four imaging units 2 respectively correspond to four colors: yellow, magenta, cyan and black. The four primary transfer rollers 3 respectively correspond to the four imaging units 2.

The general operation of the image forming device 1 will be described below. The intermediate transfer belt 4 is driven, and a predetermined area of the intermediate transfer belt 4 passes through the four imaging units 2 sequentially. The predetermined area corresponds to the image area on a paper sheet. Therefore, the size of the predetermined area is set so as to be matched with the size of a paper sheet at an image forming unit. At this time, four color toners are transferred to the predetermined area by the four imaging units 2 and the four primary transfer rollers 3. In the case that monochrome printing is performed, only the black toner is transferred to the predetermined area. On the other hand, a paper sheet 7 is conveyed between the intermediate transfer belt 4 and the secondary transfer roller 5. The timing of the movement of the predetermined area is synchronized with the timing of the conveyance of the paper sheet, and the toner transferred to the predetermined area is further transferred to the paper sheet 7. Next, the predetermined area moves to the intermediate transfer cleaner 6. The toners remaining on the intermediate transfer belt 4 are removed by the intermediate transfer cleaner 6. On the other hand, the paper sheet 7 to which the toners are transferred passes through the fixing unit 8. The toners transferred to the paper sheet 7 are fixed to the paper sheet 7 by the fixing unit 8.

In the following descriptions, three embodiments and one comparison example being different in the configuration of the imaging unit 2 will be described below. The comparison example will be described first for the convenience of description.

Comparison Example

Figure 2:
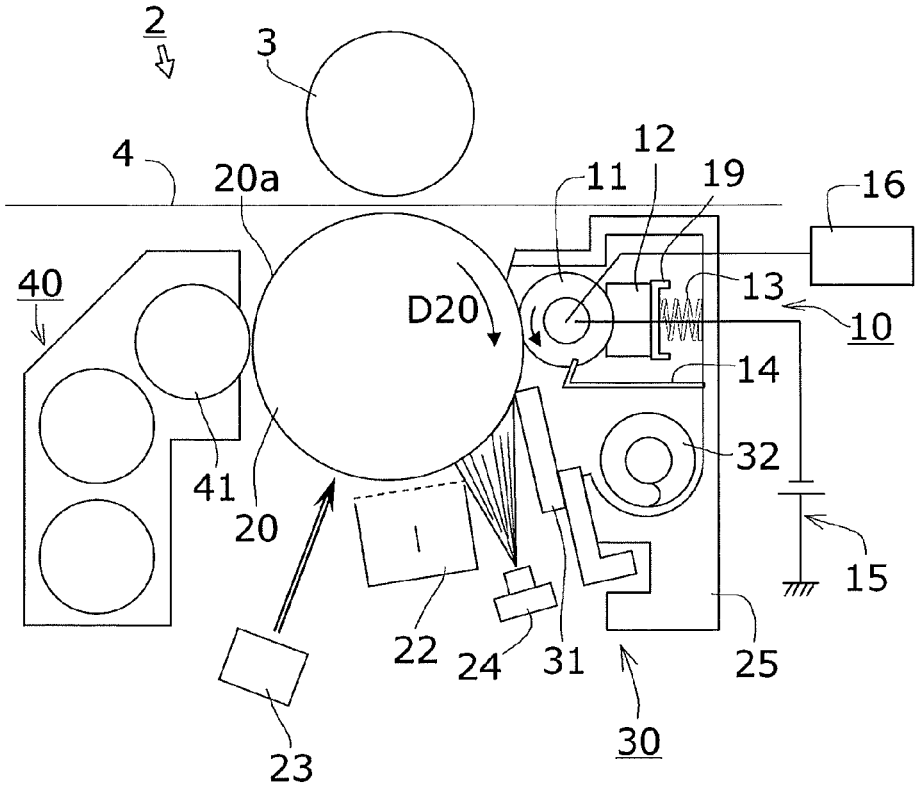
FIG. 2 is a view showing the configuration of an imaging unit (comparison example)

FIG. 2 is a view showing the configuration of the imaging unit 2 according to the comparison example. The imaging unit 2 is equipped with a photoconductive drum (image carrier) 20, a lubricant supplying unit 10, a cleaner 30, a charging unit 22, an exposure unit 23, a developing unit 40, a neutralization unit 24 and a casing 25.

The lubricant supplying unit 10 is equipped with an application brush (rotation member) 11, a solid lubricant 12, a spring (pressing unit) 13, a flicker (toner removing member) 14, a potential application circuit (potential application unit) 15 and a rotation drive unit 16. The application brush 11 is held so as to be rotatable while making contact with the photoconductive drum 11. The solid lubricant 12 is pressed by the spring 13 so as to make contact with the application brush 11. The application brush 11 is formed of brush bristles made of conductive fibers. The material of the brush bristles is conductive nylon. The solid lubricant 12 is formed by compacting dissolved zinc stearate powder. Since the solid lubricant 12 is liable to crack, the solid lubricant 12 is bonded to a metal plate 19, and the spring 13 is secured to the metal plate 19. The flicker 14 is disposed so as to make contact with the brush bristles of the application brush 11.

The cleaner 30 is equipped with a cleaning blade 31 and a recovery screw (toner recovery unit) 32. The cleaning blade 31 is a unit for scraping off the toner from the photoconductive drum 20 and is disposed so as to make contact with the photoconductive drum 20. The recovery screw 32 recovers the scraped toner by air suction.

The neutralization unit 24 is a light-emitting unit. The neutralization unit 24 is formed of a plurality of LEDs arranged along a line so that light can be emitted over the whole axial direction of the photoconductive drum 20.

The photoconductive drum 20 is rotated clockwise by a drive unit, not shown. When the photoconductive drum 20 is rotated one revolution along the rotation direction D20 thereof, the photoconductor surface 20*a* thereof is subjected to processes sequentially by the charging unit 22, the exposure unit 23, the developing unit 40, the primary transfer roller 3, the application brush 11, the cleaning blade 31 and the neutralization unit 24.

Next, the processes performed for the photoconductor surface 20*a* will be described below in more detail. First, the photoconductor surface 20*a* is charged by the action of the charging unit 22. As a result, the potential (surface potential) of the photoconductor surface 20*a* becomes −600 V.

Next, the photoconductor surface 20*a* is irradiated with the light from the exposure unit 23. As a result, the irradiated portion is neutralized. The irradiated portion of the photoconductor surface 20*a* is an image area. The image area is a portion to which the toner is attached. Since the neutralization is not performed completely, a potential of approximately −150 V remains in the image area. On the other hand, the non-irradiated portion of the photoconductor surface 20*a* is a non-image area. The surface potential of the non-image area remains −600 V.

Next, the photoconductor surface 20*a* is subjected to an electrical action by the developing unit 40. A potential of −500V is applied to the developing roller 41 of the developing unit 40. The potential of the image area is relatively on the positive side by 350 V with respect to the surface potential of the developing roller 41. The potential of the non-image area is relatively on the negative side by 100 V with respect to the surface potential of the developing roller 41. On the other hand, the toner is charged negatively by the developing unit 40. The negatively charged toner relatively moves toward a potential on the positive side. Therefore, the toner on the developing roller 41 attaches to only the image area.

Next, the photoconductor surface 20*a* is subjected to an electrical action by the primary transfer roller 3. A potential of +1 kV is applied to the primary transfer roller 3. Therefore, the toner on the photoconductor surface 20*a* moves toward the primary transfer roller 3 and attaches to the intermediate transfer belt 4 disposed therebetween. At this time, a slight amount of charges is supplied from the intermediate transfer belt 4 to the photoconductor surface 20*a*. As a result, the surface potential of the non-image area changes from −600 V to −500 V, and the surface potential of the image area changes from −150 V to −100 V.

Next, the photoconductor surface 20*a* is subjected to an electrical action and a mechanical action by the application brush 11. The rotation drive unit 16 in the lubricant supplying unit 10 actively rotates the application brush 11 counterclockwise. The rotating application brush 11 makes friction contact with the solid lubricant 12 and also makes friction contact with the photoconductor surface 20*a*. When the application brush 11 makes friction contact with the solid lubricant 12, lubricant powder 12*a* is scraped off and charged by the friction (see FIG. 3). Since the material of the application brush 11 is nylon, the charged polarity of the lubricant powder 12*a* is negative. When the application brush 11 makes friction contact with the photoconductor surface 20*a*, the lubricant powder 12*a* inside the application brush 11 moves to the photoconductor surface 20*a*.

Figure 3:
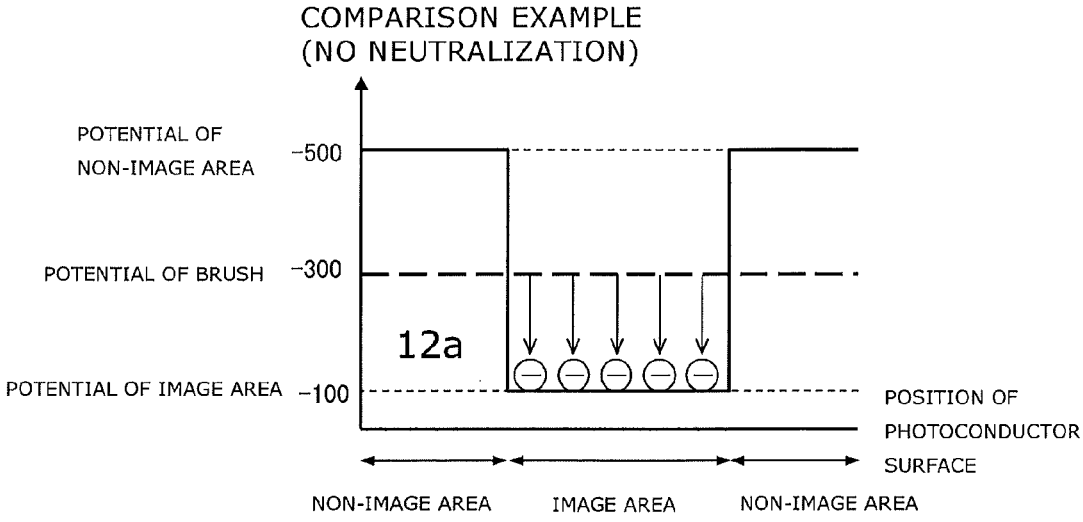
FIG. 3 is a graph showing the distribution of the surface potential of a photoconductor and the distribution of lubricant powder on the front side of an application brush (comparison example)

FIG. 3 is a graph showing the distribution of the surface potential of the photoconductive drum 20 and the distribution of the lubricant powder 12*a* on the front side of the application brush 11. In FIG. 3, the surface potential of the non-image area is −500 V, and the surface potential of the image area is −100 V. The surface potential of the photoconductive drum 20 is maintained at the potential obtained after the transfer is performed by the above-mentioned primary transfer roller 3 until the photoconductor surface 20*a* passes through the front face of the primary transfer roller 3 and the front face of the application brush 11 and reaches the front face of the neutralization unit 24.

The potential of the application brush 11 is maintained at −300 V by the potential application circuit 15. Therefore, the potential of the image area is relatively on the positive side by 200 V with respect to the potential of the application brush 11. On the other hand, the potential of the non-image area is relatively on the negative side by 200 V with respect to the potential of the application brush 11. The negatively charged lubricant powder 12*a* relatively moves toward the positive side. Therefore, the lubricant powder 12*a* inside the application brush 11 attaches to only the image area as shown in FIG. 3.

Next, the photoconductor surface 20*a* is subjected to a mechanical action by the cleaning blade 31. The toner remaining on the photoconductor surface 20*a* is scraped off by the cleaning blade 31 and recovered by the recovery screw 32 into a waste toner box. Furthermore, the lubricant powder 12*a* attaching onto the photoconductor surface 20*a* is crushed by the cleaning blade 31. As a result, a film of the lubricant is formed on the photoconductor surface 20*a*.

Next, the photoconductor surface 20*a* is irradiated with the light from the neutralization unit 24. As a result, the photoconductor surface 20*a* is neutralized over the whole axial direction of the photoconductive drum 20. In this way, the photoconductor surface 20*a* is rotated one revolution.

In the comparison example, the lubricant powder 12*a* attaches to only the image area but does not attach to the non-image area. The position of the image area changes for each print job. However, even if a print job is performed repeatedly, the positions to which the lubricant powder 12*a* attaches are not necessarily averaged. Therefore, a nonuniform lubricant application layer is eventually formed on the photoconductor surface 20*a*. In first to third embodiments described below, this problem has been solved.

(First Embodiment)

Figure 4:
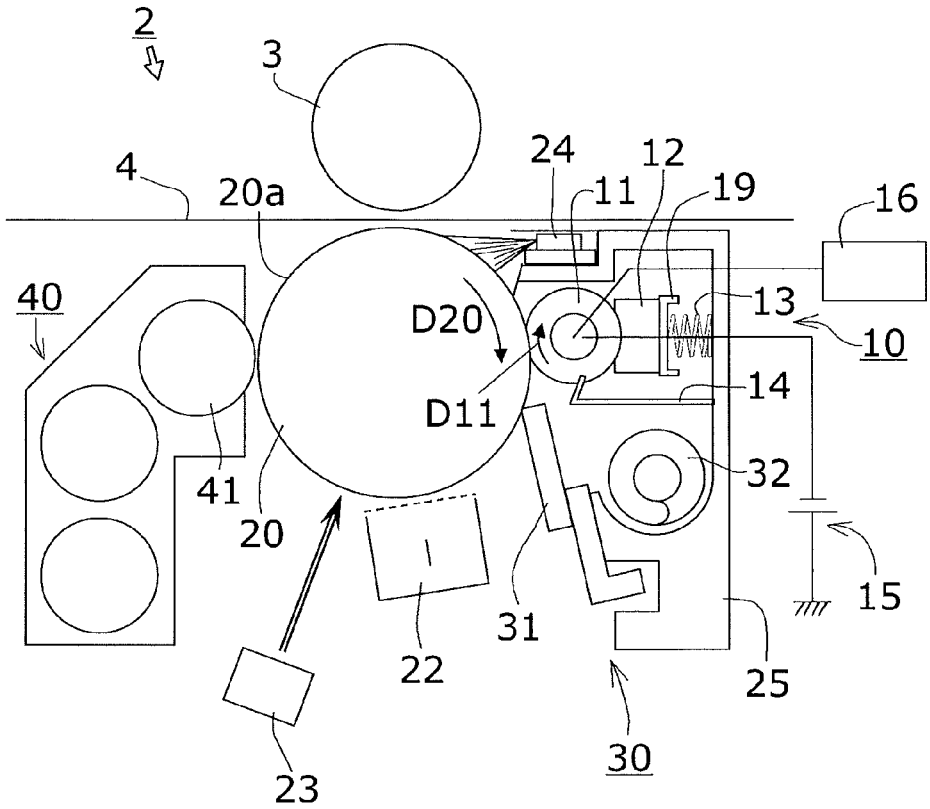
FIG. 4 is a view showing the configuration of an imaging unit (first embodiment)

FIG. 4 is a view showing the configuration of an imaging unit 2 according to a first embodiment. The first embodiment differs from the comparison example in the position of the neutralization unit 24 and the rotation direction of the application brush 11. In the first embodiment, the neutralization unit 24 is disposed between the primary transfer roller 3 and the application brush 11 in the rotation direction D20 of the photoconductive drum 20. Furthermore, the rotation direction of the application brush 11 is clockwise.

The processes performed for the photoconductor surface 20*a* will be described in more detail. The processes performed for the photoconductor surface 20*a* in the range from the charging unit 22 to the primary transfer roller 3 are similar to those in the case of the comparison example. Therefore, after the photoconductor surface 20*a* has passed through the primary transfer roller 3, the surface potential of the non-image area becomes −500 V and the surface potential of the image area becomes −100 V.

Next, the photoconductor surface 20*a* is wholly irradiated with the light from the neutralization unit 24. As a result, the photoconductor surface 20*a* is wholly neutralized over the whole axial direction of the photoconductive drum 20. Therefore, the potential of the non-image area lowers drastically and changes from −500 V to −150 V. The potential of the image area lowers slightly and changes from −100 V to −50 V.

Next, the photoconductor surface 20*a* is subjected to an electrical action by the application brush 11.

Figure 5:
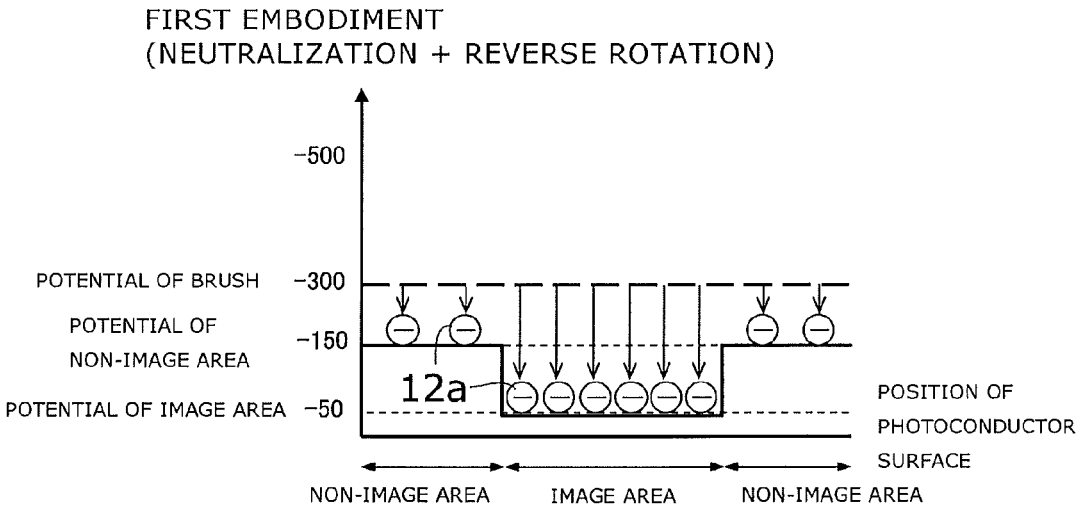
FIG. 5 is a graph showing the distribution of the surface potential of the photoconductor and the distribution of the lubricant powder on the front side of the application brush (first embodiment)

FIG. 5 is a graph showing the distribution of the surface potential of the photoconductive drum 20 and the distribution of the lubricant powder 12*a* on the front side of the application brush 11. As described above, the potential of the non-image area is −150 V, the potential of the image area is −50 V, and the potential of the application brush 11 is −300 V. The potentials of both the image area and the non-image area are relatively on the positive side with respect to the potential of the application brush 11. Therefore, the negatively charged lubricant powder 12*a* moves toward both the image area and the non-image area. However, the potential difference between the photoconductor surface 20*a* and the image area is 250 V, and the potential difference between the photoconductor surface 20*a* and the non-image area is 150 V. Therefore, the amount of the lubricant powder 12*a* attaching to the image area is larger than that attaching to the non-image area depending on the potential difference (the difference in the intensity of electric fields).

Referring to FIG. 4, the rotation drive unit 16 actively rotates the application brush 11 clockwise. The rotation direction D11 of the application brush 11 is the reverse direction with respect to the rotation direction D20 of the photoconductive drum 20. In addition, the forward and reverse directions are set on the basis of the contact portion between the two rotating bodies 11 and 20. When the rotation directions of the two rotating bodies 11 and 20 at the contact portion are different from each other, one rotation direction is the reverse direction with respect to the other rotation direction. Conversely, when the rotation directions of the two rotating bodies 11 and 20 at the contact portion are the same, one rotation direction is the forward direction with respect to the other rotation direction.

Figure 6:
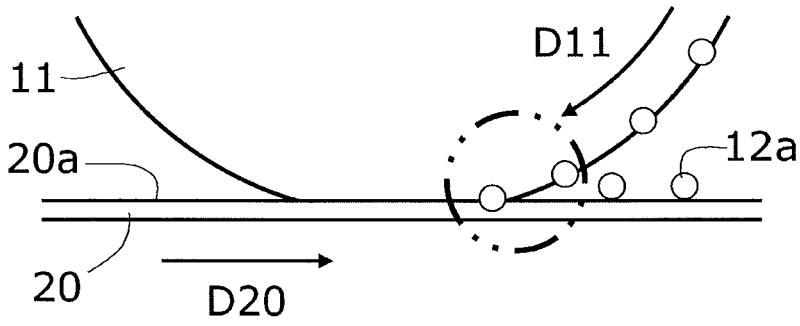
FIG. 6 is a conceptual diagram showing how the lubricant powder behaves in the case of the reverse rotation (first embodiment)

FIG. 6 is a conceptual diagram showing how the lubricant powder 12*a* behaves in the case of the reverse rotation. When the application brush 11 makes contact with the photoconductive drum 20, the lubricant powder 12*a* moves from the application brush 11 to the photoconductive drum 20. In the case of the reverse rotation, the conveying direction of the lubricant powder 12*a* is reversed before and after the movement. The lubricant powder 12*a* moves from the application brush 11 to the photoconductive drum 20 ahead of the contact portion between the application brush 11 and the photoconductive drum 20 and is conveyed away from the contact portion. The lubricant powder 12*a* having attached to the photoconductive drum 20 does not make contact with the application brush 11. In other words, the lubricant powder 12*a* on the photoconductive drum 20 is not dispersed by the application brush 11. Therefore, the positions of the particles of the lubricant powder 12*a* having attached to the photoconductive drum 20 remain unchanged. Consequently, the distribution of the lubricant powder 12*a* on the photoconductor surface 20*a* is determined only by the distribution of the potential on the photoconductor surface 20*a*.

Referring to FIG. 5, the potential difference at the non-image area is 150 V, and the potential difference at the image area is 250 V. The ratio of the potential difference at the image area to the potential difference at the non-image area is 250/150, approximately 2/1. In the case of the reverse rotation, the lubricant powder 12*a* is not dispersed by the application brush 11. Therefore, the ratio of the attached amount of the lubricant powder 12*a* per unit area at the image area to that at the non-image area is approximately 2/1.

Next, the photoconductor surface 20*a* is subjected to a mechanical action by the cleaning blade 31. As a result, the toner having not been transferred is recovered, and a lubricant film is formed on the photoconductor surface 20*a*.

The first embodiment has the following functions and effects.

Since the material of the application brush 11 is nylon and the material of the solid lubricant 12 is zinc stearate, the solid lubricant 12 is charged negatively when the solid lubricant 12 makes friction contact with the application brush 11. The lubricant powder 12*a* scraped off with the application brush 11 is also charged negatively as a matter of course. When the photoconductor surface 20*a* is neutralized by the neutralization unit 24, the surface potential of the image area becomes −50 V, and the surface potential of the non-image area becomes −150 V. The potential application circuit 15 applies the potential of −300 V to the application brush 11. In addition, the polarity of the potential applied to the application brush 11 is negative, like the charged polarity of the photoconductor surface 20*a*. The potentials applied to the rotating bodies are set so that the negative charges are attracted from the application brush 11 to the neutralized photoconductor surface 20*a*. The charged polarity of the application brush 11 is negative, the polarity of the potential applied to the application brush 11 is negative, and the charged polarity of the photoconductor surface 20*a* is also negative. Therefore, when the potential to be applied to the rotation member is set so as to be lower than the surface potential of the photoconductive drum 20, the negative charges are attracted from the application brush 11 to the neutralized photoconductor surface 20*a*. The potential applied to the application brush 11 is thus set to −300 V. The potential of −300 V is lower than the surface potential (−50 V or −150 V) of the neutralized photoconductor surface 20*a*. Therefore, the lubricant powder 12*a* moves from the application brush 11 to the neutralized photoconductor surface 20*a* and attaches to the photoconductor surface 20*a*.

In the first embodiment, an electric field is formed between the application brush 11 and the photoconductor surface 20*a* so that the negative charges are attracted from the application brush 11 to the neutralized photoconductor surface 20*a*. Therefore, the lubricant powder 12*a* scraped off with the application brush 11 attaches to not only one of the image area and the non-image area but also both of them. Consequently, in the first embodiment, the lubricant powder 12*a* attaching to the photoconductor surface 20*a* can be prevented from being distributed unevenly. Furthermore, since the charged polarity of the toner is the same as the charged polarity of the lubricant powder 12*a*, the toner does not attach to the application brush 11. To make an electrophotographic process device compact and to make the solid lubricant 12 larger in size are not demanded to provide the above-mentioned configuration in the image forming device 1. Consequently, in the first embodiment, the application brush 11 can be prevented from being stained with the toner while the cost is prevented from increasing.

(Second Embodiment)

Figure 7:
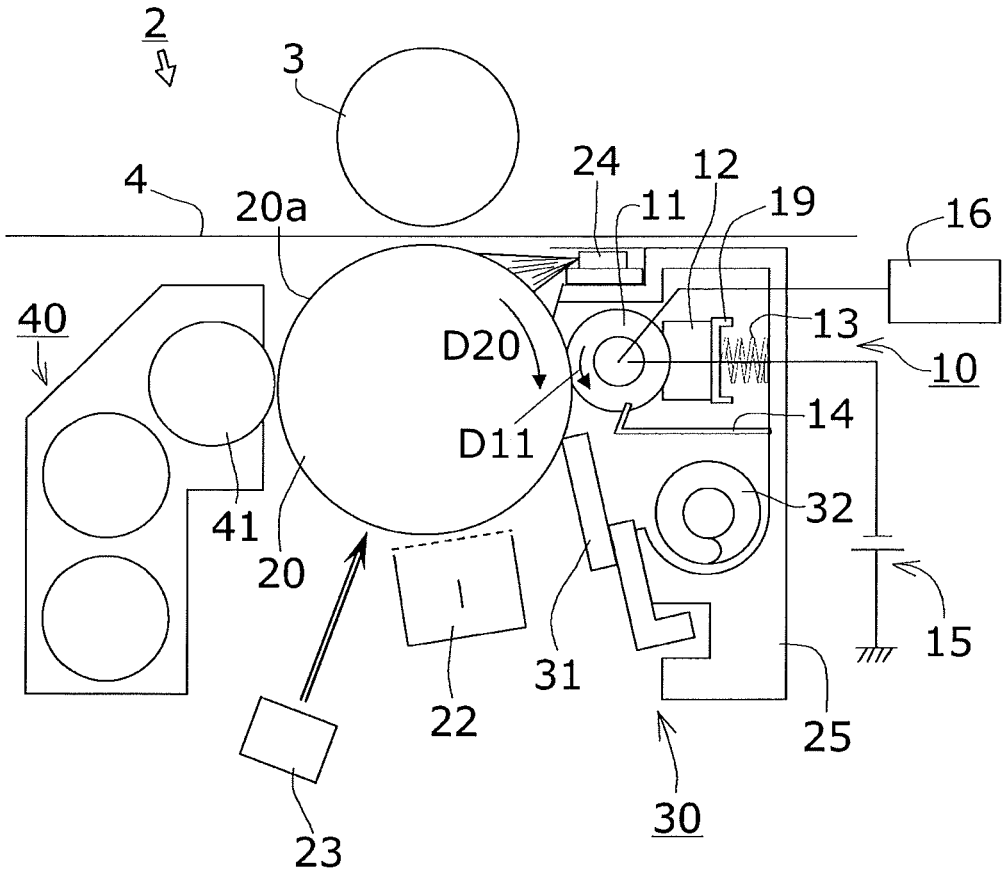
FIG. 7 is a view showing the configuration of an imaging unit (second embodiment)

FIG. 7 is a view showing the configuration of an imaging unit 2 according to a second embodiment. The second embodiment has a configuration similar to that of the first embodiment. The second embodiment differs from the first embodiment only in the rotation direction of the application brush 11.

Referring to FIG. 7, the rotation drive unit 16 actively rotates the application brush 11 counterclockwise. The rotation direction D11 of the application brush 11 is the forward direction with respect to the rotation direction D20 of the photoconductive drum 20. The forward and reverse directions are set on the basis of the contact portion between the two rotating bodies 11 and 20 as described above.

Furthermore, the linear velocity V11 of the application brush 11 is set so as to be equal to or higher than the linear velocity V20 of the photoconductive drum 20 or more. In other words, the ratio θ of the linear velocity of the application brush 11 to the linear velocity of the photoconductive drum 20 is 1 or more. $\theta = V11/V20 \geqq 1$. The linear velocity ratio θ is set to 1.2, for example.

Figure 8:
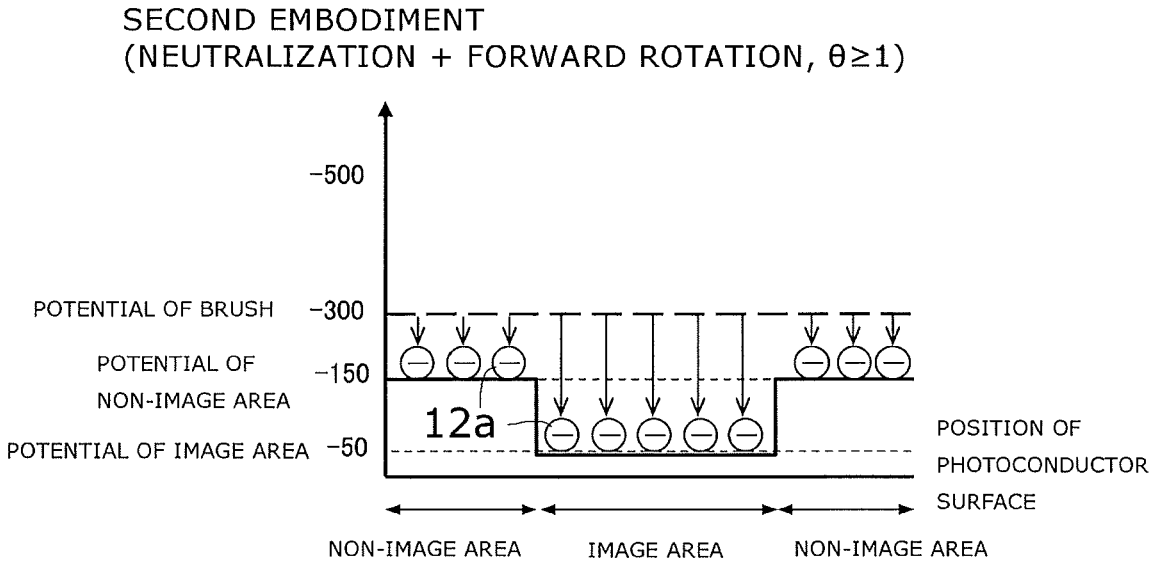
FIG. 8 is a graph showing the distribution of the surface potential of the photoconductor and the distribution of the lubricant powder on the front side of the application brush (second embodiment)

FIG. 8 is a graph showing the distribution of the surface potential of the photoconductive drum 20 and the distribution of the lubricant powder 12*a* on the front side of the application brush 11. As in the case of the first embodiment (FIG. 5), the potential of the non-image area is −150 V, the potential of the image area is −50 V, and the potential of the application brush 11 is −300 V.

Figure 9:
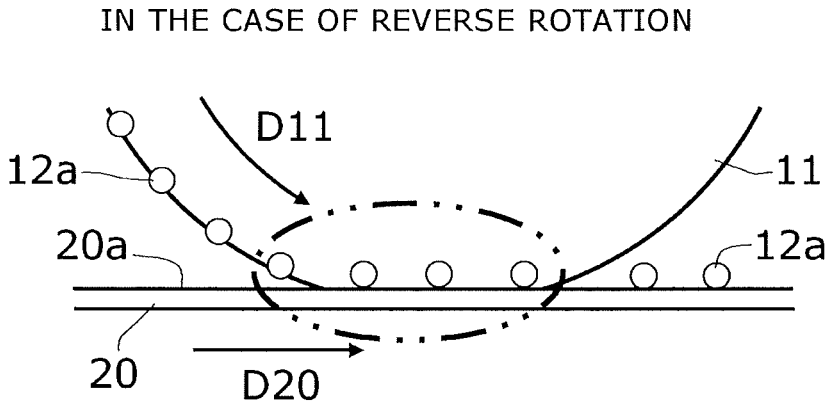
FIG. 9 is a conceptual diagram showing how the lubricant powder behaves in the case of the forward rotation.

FIG. 9 is a conceptual diagram showing how the lubricant powder 12*a* behaves in the case of the forward rotation. When the application brush 11 makes contact with the photoconductive drum 20, the lubricant powder 12*a* moves from the application brush 11 to the photoconductive drum 20. In the case of the forward rotation, the conveying direction of the lubricant powder 12*a* remains unchanged before and after the movement. Therefore, the lubricant powder 12*a* passes through the contact portion between the application brush 11 and the photoconductive drum 20, thereby being held between the application brush 11 and the photoconductive drum 20. Since the lubricant powder 12*a* on the photoconductor surface 20*a* is dispersed by the application brush 11, the positions of the particles of the lubricant powder 12*a* having attached to the photoconductive drum 20 are changed. Consequently, the distribution of the lubricant powder 12*a* on the photoconductor surface 20*a* differs from the distribution of the potential on the photoconductor surface 20*a*. The distribution of the lubricant powder 12*a* is less uneven than the distribution of the potential.

Referring to FIG. 8, the potential difference at the non-image area is 150 V, and the potential difference at the image area is 250 V as described above. The ratio of the potential difference at the image area to the potential difference at the non-image area is 250/150, approximately 2/1. In the case of the forward rotation, the lubricant powder 12*a* is dispersed by the application brush 11. Therefore, the ratio of the attached amount of the lubricant powder 12*a* per unit area at the image area to that at the non-image area is a value (3/2, for example) smaller than 2/1.

The second embodiment has the following functions and effects in addition to the functions and effects of the first embodiment. Since the application brush 11 rotates in the forward direction with respect to the photoconductive drum 20 in the second embodiment, the lubricant powder 12*a* is dispersed on the photoconductor surface 20*a*. Consequently, in the second embodiment, the distribution of the lubricant powder 12*a* can be averaged more uniformly.

(Third Embodiment)

The third embodiment has a configuration similar to that of the second embodiment. The third embodiment differs from the second embodiment only in the linear velocity ratio θ.

The linear velocity V11 of the application brush 11 is set so as to be lower than the linear velocity V20 of the photoconductive drum 20. In other words, the ratio θ of the linear velocity of the application brush 11 to the linear velocity of the photoconductive drum 20 is smaller than 1. θ=V11/V20<1. The linear velocity ratio θ is set to 0.7, for example.

Figure 10:
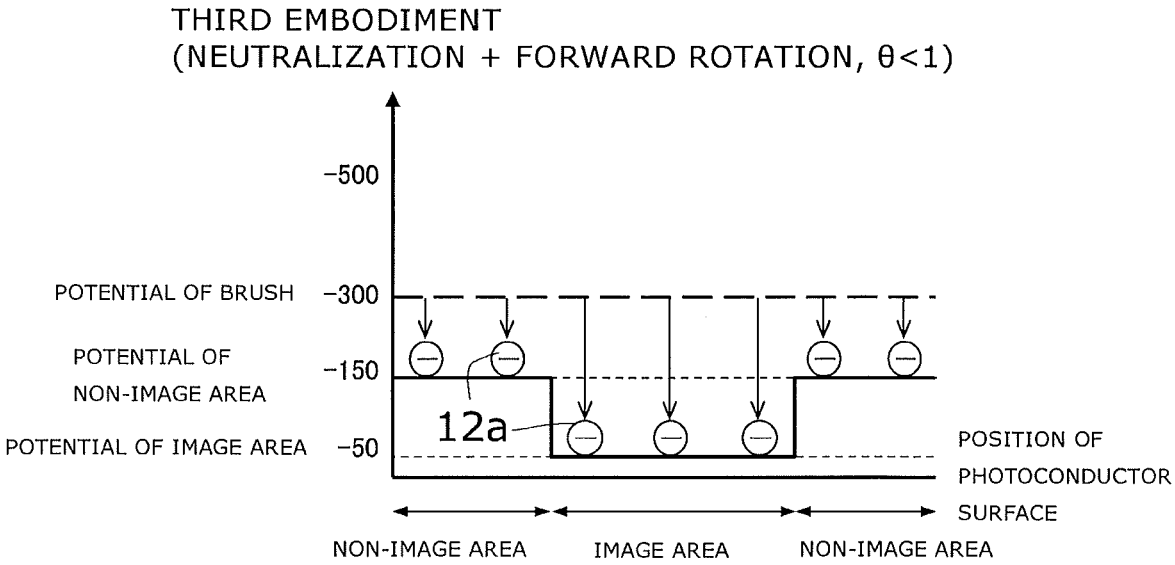
FIG. 10 is a graph showing the distribution of the surface potential of the photoconductor and the distribution of the lubricant powder on the front side of the application brush (third embodiment).

FIG. 10 is a graph showing the distribution of the surface potential of the photoconductive drum 20 and the distribution of the lubricant powder 12*a* on the front side of the application brush 11. As in the cases of the first and second embodiments (FIGS. 5 and 8), the potential of the non-image area is −150 V, the potential of the image area is −50 V, and the potential of the application brush 11 is −300 V.

In the third embodiment, the application brush 11 rotates in the forward direction. Therefore, the lubricant powder 12*a* basically behaves similarly as in the case of the second embodiment, and the lubricant powder 12*a* is dispersed by the application brush 11. In the third embodiment, the linear velocity ratio θ is smaller than 1. In the case that the linear velocity ratio θ differs from 1, the relative velocity between the application brush 11 and the photoconductive drum 20 is not 0. As the linear velocity ratio θ is away from 1, the relative velocity between the application brush 11 and the photoconductive drum 20 increases. Therefore, as the linear velocity ratio θ is away from 1, the lubricant powder 12*a* on the photoconductor surface 20*a* is dispersed more extensively. However, when the linear velocity ratio θ becomes larger than 1, the surface area of the application brush 11 making contact with the photoconductor surface 20*a* having a constant area increases. As a result, the supply amount of the lubricant powder 12*a* per unit time, supplied from the application brush 11 to the photoconductive drum 20, increases. If the lubricant powder 12*a* is supplied excessively, an improper image is generated. On the other hand, when the linear velocity ratio θ is smaller than 1, the effect of dispersing the lubricant powder 12*a* is obtained without the lubricant powder 12*a* being supplied excessively.

The third embodiment has the following functions and effects in addition to the functions and effects of the second embodiment. Since the linear velocity ratio θ is smaller than 1 in the third embodiment, the lubricant powder 12*a* on the photoconductor surface 20*a* is dispersed extensively by the application brush 11. Furthermore, the lubricant powder 12*a* is not supplied excessively. Consequently, in the third embodiment, the distribution of the lubricant powder 12*a* can be averaged more uniformly without excessively supplying the lubricant powder 12*a*.

(Variations)

The following variant configurations can be adopted in the present invention.

The image carrier is not limited to the photoconductive drum 20 having a drum shape. The image carrier may be an endless member, such as a belt.

Any potential in the range of −200 V to −500 V can be used as the potential applied to the application brush 11 in the case that the polarity is negative. In the case that the potential is within this range, discharge does not occur.

The neutralization unit 24 is not limited to the light-emitting unit.

The rotation member is not limited to the application brush 11. A rotating body having conductivity and capable of holding a lubricant can be used as the rotation member. A foaming roller or a solid roller other than the brush member can be used as the shape of the rotation member.

A material situated on the positive polarity side of the material of the solid lubricant 12 in the triboelectric series can be used as the material of the rotation member so that the solid lubricant 12 is negatively charged by virtue of friction. For example, nylon, acrylic or polyester can be used as the material of the rotation member. A metal salt of a fatty acid, such as magnesium stearate or lithium stearate, other than zinc stearate can be used as the material of the solid lubricant 12.

The positive polarity can be used instead of the negative polarity as the charged polarity of the solid lubricant 12, provided that the other conditions are satisfied. In this case, the charged polarity of the toner is set to positive so as to be matched with the charged polarity of the solid lubricant 12. In addition, the potential to be applied to the application brush 11 is set so that the charges having the same polarity as the charged polarity of the solid lubricant 12 are attracted from the application brush 11 to the neutralized photoconductive drum 20 depending on the relationship between the charged polarity of the solid lubricant 12 and the polarity of the potential to be applied to the application brush 11. In the case that the charged polarity of the photoconductive drum 20 is the same as the polarity of the potential to be applied to the application brush 11, the potential to be applied to the rotation member is set so as to be lower than the surface potential of the neutralized image carrier. This corresponds to the cases of the comparison example and the embodiments described above. On the other hand, in the case that the charged polarity of the photoconductive drum 20 is different from the polarity of the potential to be applied to the application brush 11, the potential to be applied to the rotation member is set so as to be higher than the surface potential of the neutralized image carrier.

Test Examples

TABLE 1 is a list showing the results of image evaluation obtained from endurance tests in test examples 1 to 28. The image evaluation is done with respect to center falling out and scattering. Five items are shown in TABLE 1. Test examples 1 to 28 are different from one another at least in one item. The five items are the position of the neutralization unit 24, the linear velocity of the photoconductor 20, the applied potential of the application brush 11, the rotation direction of the application brush 11 and the linear velocity ratio θ. The position of the neutralization unit 24 is set with reference to the position of the cleaner 30. The comparison example and the first to third embodiments described above are included in test examples 1 to 28.

TABLE 1

| | Neutralization unit | Linear velocity of photoconductor | Applied potential of application brush | Rotation direction of application brush | Linear velocity ratio | Improper Image: Center falling out | Improper Image: Scattering |
|---|---|---|---|---|---|---|---|
| Test example 1 | Upstream | 165 mm/s | −300 V | Forward direction | 0.6 | ◎ | ◎ |
| Test example 2 (3rd embodiment) | ↓ | ↓ | ↓ | ↓ | 0.7 | ◎ | ◎ |
| Test example 3 | ↓ | ↓ | ↓ | ↓ | 0.8 | ◎ | ◎ |
| Test example 4 | ↓ | ↓ | ↓ | ↓ | 0.9 | ◎ | ◎ |
| Test example 5 | ↓ | ↓ | ↓ | ↓ | 0.95 | ◎ | ◎ |
| Test example 6 | ↓ | ↓ | ↓ | ↓ | 1.0 | ◎ | ○ |
| Test example 7 | ↓ | ↓ | ↓ | ↓ | 1.1 | ◎ | ○ |
| Test example 8 (2nd embodiment) | ↓ | ↓ | ↓ | ↓ | 1.2 | ◎ | ○ |
| Test example 9 | ↓ | 310 mm/s | ↓ | ↓ | 0.6 | ◎ | ◎ |
| Test example 10 (3nd embodiment) | ↓ | ↓ | ↓ | ↓ | 0.7 | ◎ | ◎ |
| Test example 11 | ↓ | ↓ | ↓ | ↓ | 0.8 | ◎ | ◎ |
| Test example 12 | ↓ | ↓ | ↓ | ↓ | 0.9 | ◎ | ◎ |
| Test example 13 | ↓ | ↓ | ↓ | ↓ | 0.95 | ◎ | ◎ |
| Test example 14 | ↓ | ↓ | ↓ | ↓ | 1.0 | ◎ | ◎ |
| Test example 15 | ↓ | ↓ | ↓ | ↓ | 1.1 | ◎ | ◎ |
| Test example 16 (2nd embodiment) | ↓ | ↓ | ↓ | ↓ | 1.2 | ◎ | ○ |
| Test example 17 | ↓ | ↓ | −100 V | ↓ | 0.7 | ○ | ◎ |
| Test example 18 | ↓ | ↓ | −150 V | ↓ | ↓ | ○ | ◎ |
| Test example 19 | ↓ | ↓ | −200 V | ↓ | ↓ | ◎ | ◎ |
| Test example 20 | ↓ | ↓ | −500 V | ↓ | ↓ | ◎ | ◎ |
| Test example 21 | ↓ | ↓ | −550 V | ↓ | ↓ | ◎ | ○ |
| Test example 22 | ↓ | ↓ | −700 V | ↓ | ↓ | ◎ | ○ |
| Test example 23 | ↓ | ↓ | ↓ | Reverse direction | 1.0 | ○ | Δ |
| Test example 24 (1st embodiment) | ↓ | ↓ | ↓ | ↓ | 1.2 | ◎ | X |
| Test example 25 | Downstream | ↓ | GND | Forward direction | 0.7 | Δ | ◎ |
| Test example 26 | ↓ | ↓ | +300 V | ↓ | ↓ | Δ | ◎ |
| Test example 27 (comparison example) | ↓ | ↓ | −300 V | ↓ | ↓ | Δ | ◎ |
| Test example 28 | ↓ | ↓ | ↓ | Reverse direction | ↓ | Δ | ◎ |

◎: "double circle"
Δ: "triangle"
○: "circle"
X: "cross"

The image forming device 1 used for the tests is BiZhubC450 (A4Y 35 sheets/minute, 600 dpi) produced by Konica Minolta Business Technologies, Inc. The pressing force of the spring 13 is 2 N/m$^2$. The cleaning blade 31, made of polyurethane rubber, has a JIS-A hardness of 77 degrees, a rebound resilience of 35%, a contact force of 25 N/m$^2$ exerted to the photoconductor surface 20*a* and a contact angle of 15 degrees. Endurance conditions for evaluating the scattering are: the temperature is 10° C., the RH is 15%, and a grid line image (blue) having an image density of approximately 1% for each color is printed on 1K sheets one-by-one intermittently. The evaluation for the scattering was conducted for the image obtained after the printing of 1K sheets. Endurance conditions for evaluating the center falling out are: the temperature is 30° C., the RH is 85%, and a grid line image (blue) having an image density of approximately 20% for each color is printed on 1K sheets one-by-one intermittently. The evaluation for the center falling out was conducted for the 6-dot line image (blue) obtained after the printing of 1K sheets.

In TABLE 1, the results of the evaluation for the center falling out and the evaluation for the scattering are indicated by "double circle", "circle", "triangle" and "cross". Mark of "double circle" indicates a level at which no problem is found in the image. Mark of "circle" indicates a level at which no problem is found in the image although the center falling out or the scattering is recognized. Mark of "triangle" indicates a level at which the center falling out or the scattering is recognized in the image and some users are dissatisfied with the quality of the image. Mark of "cross" indicates a level at which many users are dissatisfied with the quality of the image.

The invention claimed is:

1. An image forming device comprising:

a rotation member having conductivity and being held rotatably while making contact with an image carrier;

a rotation drive unit for rotating the rotation member;

a solid lubricant pressed so as to make contact with the rotation member;

a cleaning blade making contact with the image carrier so as to scrape off toner; and a potential application unit for applying a potential having the same polarity as the charged polarity of the image carrier to the rotation member, wherein a developing unit, a transfer unit, a neutralization unit, the rotation member and the cleaning blade are arranged in this order along the movement direction of the surface of the image carrier, the material of the solid lubricant and the material of the rotation member are selected so that the charged polarity of the solid lubricant charged due to the friction between the rotation member and the solid lubricant becomes identical with the charged polarity of the toner charged by the developing unit, the potential to be applied to the rotation member is set so as to be higher or lower than the surface potential of the neutralized image carrier so that the charges having the same polarity as the charged polarity of the solid lubricant are attracted from the rotation member to the neutralized image carrier, and the linear velocity of the rotation member is set so as to be lower than the linear velocity of the image carrier.

2. The image forming device according to claim 1, wherein the rotation direction of the rotation member is set to move a surface thereof in contact with the image carrier in the forward direction with respect to the movement direction of the surface of the image carrier in contact with the rotation member.

3. The image forming device according to claim 1, wherein the potential applied to the rotation member is set within the range of −200 V to −500 V.

4. The image forming device according to claim 1, wherein the neutralization unit is a light-emitting unit.

5. The image forming device according to claim 1, wherein the material of the rotation member is nylon, acrylic or polyester.

6. The image forming device according to claim 1, wherein the toner has negative electrification characteristic, and the rotation member contains a material situated on the positive polarity side of the material of the solid lubricant in the triboelectric series.

7. The image forming device according to claim 1, wherein the solid lubricant contains a metal salt of a fatty acid.

8. An image forming device comprising:

a rotation member having conductivity and being held rotatably while making contact with an image carrier;

a rotation drive unit for rotating the rotation member;

a solid lubricant pressed so as to make contact with the rotation member;

a cleaning blade making contact with the image carrier so as to scrape off toner; and a potential application unit for applying a potential having the same polarity as the charged polarity of the image carrier to the rotation member, wherein a developing unit, a transfer unit, a neutralization unit, the rotation member and the cleaning blade are arranged in this order along the movement direction of the surface of the image carrier, the material of the solid lubricant and the material of the rotation member are selected so that the charged polarity of the solid lubricant charged due to the friction between the rotation member and the solid lubricant becomes identical with the charged polarity of the toner charged by the developing unit, the potential to be applied to the rotation member is set so as to be higher or lower than the surface potential of the neutralized image carrier so that the charges having the same polarity as the charged polarity of the solid lubricant are attracted from the rotation member to the neutralized image carrier, the toner has negative electrification characteristic, and the rotation member contains a material situated on the positive polarity side of the material of the solid lubricant in the triboelectric series.

9. The image forming device according to claim 8, wherein the rotation direction of the rotation member is set to move a surface thereof in contact with the image carrier in the forward direction with respect to the movement direction of the surface of the image carrier in contact with the rotation member.

10. The image forming device according to claim 8, wherein the potential applied to the rotation member is set within the range of −200 V to −500 V.

11. The image forming device according to claim 8, wherein the neutralization unit is a light-emitting unit.

12. The image forming device according to claim 8, wherein the material of the rotation member is nylon, acrylic or polyester.

13. The image forming device according to claim 8, wherein the solid lubricant contains a metal salt of a fatty acid.

* * * * *